US012582865B2

(12) United States Patent
Thomas

(10) Patent No.: US 12,582,865 B2
(45) Date of Patent: Mar. 24, 2026

(54) SUSPENSION SLING ABDOMINAL EXERCISE DEVICE

(71) Applicant: Andrew B Thomas, Tampa, FL (US)

(72) Inventor: Andrew B Thomas, Tampa, FL (US)

( * ) Notice: Subject to any disclaimer, the term of this patent is extended or adjusted under 35 U.S.C. 154(b) by 130 days.

(21) Appl. No.: 18/660,543

(22) Filed: May 10, 2024

(65) Prior Publication Data

US 2025/0345651 A1 Nov. 13, 2025

(51) Int. Cl.
*A63B 21/00* (2006.01)
*A63B 21/068* (2006.01)
*A63B 23/02* (2006.01)

(52) U.S. Cl.
CPC ..... *A63B 21/154* (2013.01); *A63B 21/068* (2013.01); *A63B 21/4007* (2015.10); *A63B 21/4017* (2015.10); *A63B 21/4035* (2015.10); *A63B 23/0216* (2013.01); *A63B 2208/029* (2013.01)

(58) Field of Classification Search
CPC ..... A63B 21/4035; A63B 21/4017; A63B 21/4007; A63B 21/068; A63B 21/154; A63B 2208/029; A63B 23/0216
See application file for complete search history.

(56) References Cited

U.S. PATENT DOCUMENTS 5,122,107 A 6/1992 Gardner
7,255,666 B2 * 8/2007 Cardenas ..... A63B 7/02 482/69
7,585,263 B2 9/2009 Brown et al.
7,611,445 B2 11/2009 Brown et al.
8,029,425 B2 10/2011 Bronston et al.
8,696,528 B2 4/2014 Campanaro et al.
8,708,873 B2 4/2014 Birch et al.
8,870,726 B2 10/2014 Watterson et al.
9,050,496 B2 6/2015 Towley, III et al.
10,245,460 B2 * 4/2019 Hetrick ..... A63B 21/068
10,500,122 B2 12/2019 Aryananda et al.
10,695,601 B2 * 6/2020 Souffrain ..... A63B 1/00
10,737,136 B2 * 8/2020 Burkinshaw ..... A63B 21/1636
2010/0048368 A1 2/2010 Donofrio
2018/0178050 A1 * 6/2018 Prihar ..... A63B 21/4035
2025/0242184 A1 * 7/2025 Alabdullatif ..... A63B 21/4035

* cited by examiner

*Primary Examiner* — Loan B Jimenez
*Assistant Examiner* — Jonathan A Dicuia
(74) *Attorney, Agent, or Firm* — Pablo Meles

(57) ABSTRACT

A pulley system for assisting in the performance of exercises includes a first and a second belt member each having an attachment ring member on a first end and a handle on an opposing end, where the attachment ring members are configured for attachment to a horizontal bar and the first and second belt members are configured each for having a portion of the belt member and the belt member overhanging the horizontal pullup bar. The pulley system further includes an arm support member having at least two pulley elements each interfacing with respective intermediate sections of the first and second belt members which are threaded through the at least two pulley elements and where the pulley system is configured for supporting a user under their arms using the arm support member while the user simultaneously grabs the overhanging handles for enabling the user to enhance a leg lifting exercise.

20 Claims, 7 Drawing Sheets

100

200

300

400

400

500

600

700

705

800

850

900

SUSPENSION SLING ABDOMINAL EXERCISE DEVICE

CROSS-REFERENCE TO RELATED APPLICATIONS

Not applicable

BACKGROUND

The present disclosure is directed to an apparatus and system for aiding in the performance of abdominal exercises.

DESCRIPTION OF THE RELATED ART

Current methods to address some of the issues resolved by the current embodiments use devices that create poor posture or form, and/or cut-off a user's circulation. Some existing devices may require the assistance of a third party.

SUMMARY

Figure 1:
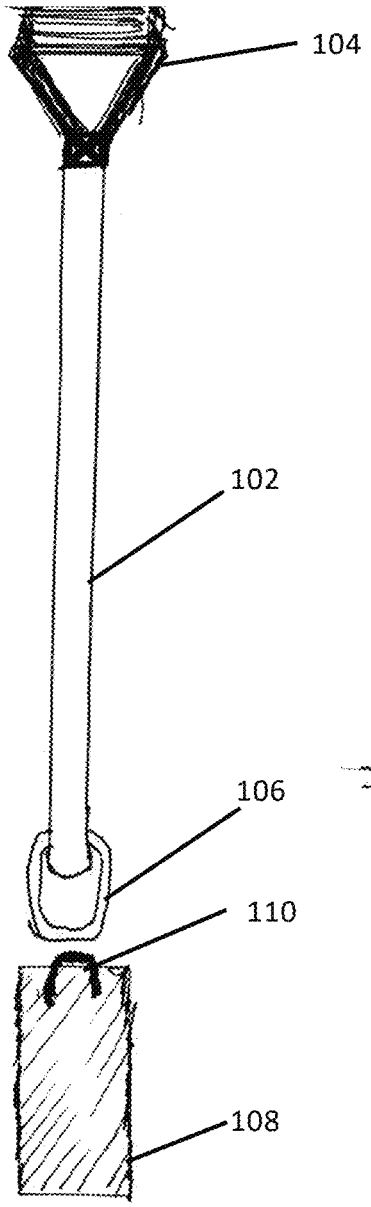
FIG. 1 illustrates a front view of a single pulley strap and support member or cuff used for abdominal strength training in accordance with the embodiments.

In some embodiments, a pulley system for assisting in the performance of exercises can include a first belt member having an attachment ring member on a first end and a handle on an opposing end, and a second belt member having an attachment ring member on a first end and a handle on an opposing end, where the attachment ring members are configured for attachment to a horizontal pull-up bar and the first belt member and the second belt members are configured each for having a portion of the belt member and the belt member over-hanging the horizontal pullup bar. The pulley system can further include an arm support member having at least two pulley elements each interfacing with respective intermediate sections of the first belt member and the second belt member which are threaded through the at least two pulley elements, and where the pulley system is configured for supporting a user under their arms using the arm support member while the user simultaneously grabs the overhanging handles for enabling the user to enhance a leg lifting exercise.

In some embodiments, the attachment ring members of the first belt member and the second belt member are each a carabiner.

In some embodiments, the first belt member and the second belt member are each a rope.

In some embodiments, the first belt member and the second belt member are each a weaved nylon fabric.

In some embodiments, the arm sling support member includes a first arm cuff having a D-ring where the first belt member is configured to thread through the D-ring of the first arm cuff and the arm sling support member includes a second arm cuff having a D-ring wherein the second belt member is configured to thread through the D-ring of the of the second arm cuff. In some embodiments, the first arm cuff and the second arm cuff are each adjustable using hook and loop fastener elements such as Velcro.

In some embodiments, the arm support member includes a first arm cuff having a pulley-member where the first belt member is configured to thread through the pulley-member of the first arm cuff and the arm support member includes a second arm cuff having a pulley-member where the second belt member is configured to thread through the pulley member of the of the second arm cuff. In some embodiments, the first arm cuff and the second arm cuff are each adjustable using hook and loop fastener elements.

In some embodiments, the arm support member includes a third belt member having a first D-ring and a second D-ring respectively on opposing ends where the first belt member is configured to thread through the first D-ring of the third belt member and the second belt member is configured to thread through the second D-ring of the third belt member. In some embodiments, the third belt member is surrounded by a cushioned foam layer.

In some embodiments, the arm support member includes a third belt member having a first pulley and a second pulley respectively on opposing ends where the first belt member is configured to thread through the first pulley of the third belt member and the second belt member is configured to thread through the second pulley of the third belt member.

In some embodiments, a pulley system for assisting in the performance of exercises includes a first belt member having an attachment ring member on a first end and a handle on an opposing end, a second belt member having an attachment ring member on a first end and a handle on an opposing end, where the attachment ring members are configured for attachment to a horizontal pull-up bar and the first belt member and the second belt members are configured each for having a portion of the belt member and the belt member over-hanging the horizontal pullup bar. In some embodiments, the pulley system can further include a first arm cuff having a D-ring where the first belt member is configured to thread through the D-ring of the first arm cuff and a second arm cuff having a D-ring where the second belt member is configured to thread through the D-ring of the of the second arm cuff, where the D-rings serve as pulley elements each interfacing with respective intermediate sections of the first belt member and the second belt member which are threaded through the pulley elements. In some embodiments, the pulley system is configured for supporting a user under their arms using the first arm cuff and second arm cuff while the user simultaneously grabs the overhanging handles for enabling the user to enhance a leg lifting exercise.

In some embodiments, the attachment ring members of the first belt member and the second belt member are each a carabiner.

In some embodiments, the first belt member and the second belt member are each a rope.

In some embodiments, the first belt member and the second belt member are each a weaved nylon fabric.

In some embodiments, the first arm cuff and the second arm cuff are each adjustable using hook and loop fastener elements such as Velcro.

In some embodiments, a pulley system for assisting in the performance of exercises includes a first belt member having an attachment ring member on a first end and a handle on an opposing end, a second belt member having an attachment ring member on a first end and a handle on an opposing end, where the attachment ring members are configured for attachment to a horizontal pull-up bar and the first belt member and the second belt members are configured each for having a portion of the belt member and the belt member over-hanging the horizontal pullup bar. In some embodiments, the pulley system further includes a first arm cuff having a pulley element where the first belt member is configured to thread through the pulley element of the first arm cuff and a second arm cuff having a pulley element where the second belt member is configured to thread through the pulley element of the of the second arm cuff, where the pulley elements serve as pulley elements each interfacing with respective intermediate sections of the first belt member and the second belt member which are threaded through the pulley elements. In some embodiments, the pulley system is configured for supporting a user under their arms using the first arm cuff and second arm cuff while the user simultaneously grabs the overhanging handles for enabling the user to enhance a leg lifting exercise.

In some embodiments, the pulley element of the first arm cuff and the pulley element of the second arm cuff are each D-rings.

In some embodiments, the pulley element of the first arm cuff and the pulley element of the second arm cuff are each a pulley. In some embodiments, the first belt member and the second belt member are each a rope.

DETAILED DESCRIPTION

The embodiments disclosed herein introduce a biomechanically optimized system and method of utilizing a two-pulley, single-rope or strap configuration (times two) to enhance the efficacy of leg lift exercises with abdominal or ab straps. The proposed system provides users with a mechanical advantage, effectively reducing the required effort for suspension and prolonging the duration of muscular engagement. This system and method aim to improve abdominal muscle activation and endurance during leg lift exercises.

Leg lift exercises, renowned for their ability to target the core and hip flexors, often pose challenges in sustaining suspension for prolonged periods. The disclosed embodiments herein seek to address this limitation by employing a two-pulley, single-rope or single strap configuration (times two), which capitalizes on the mechanical advantage of pulleys to optimize the biomechanical efficiency of leg lifts with ab straps.

Figure 6:
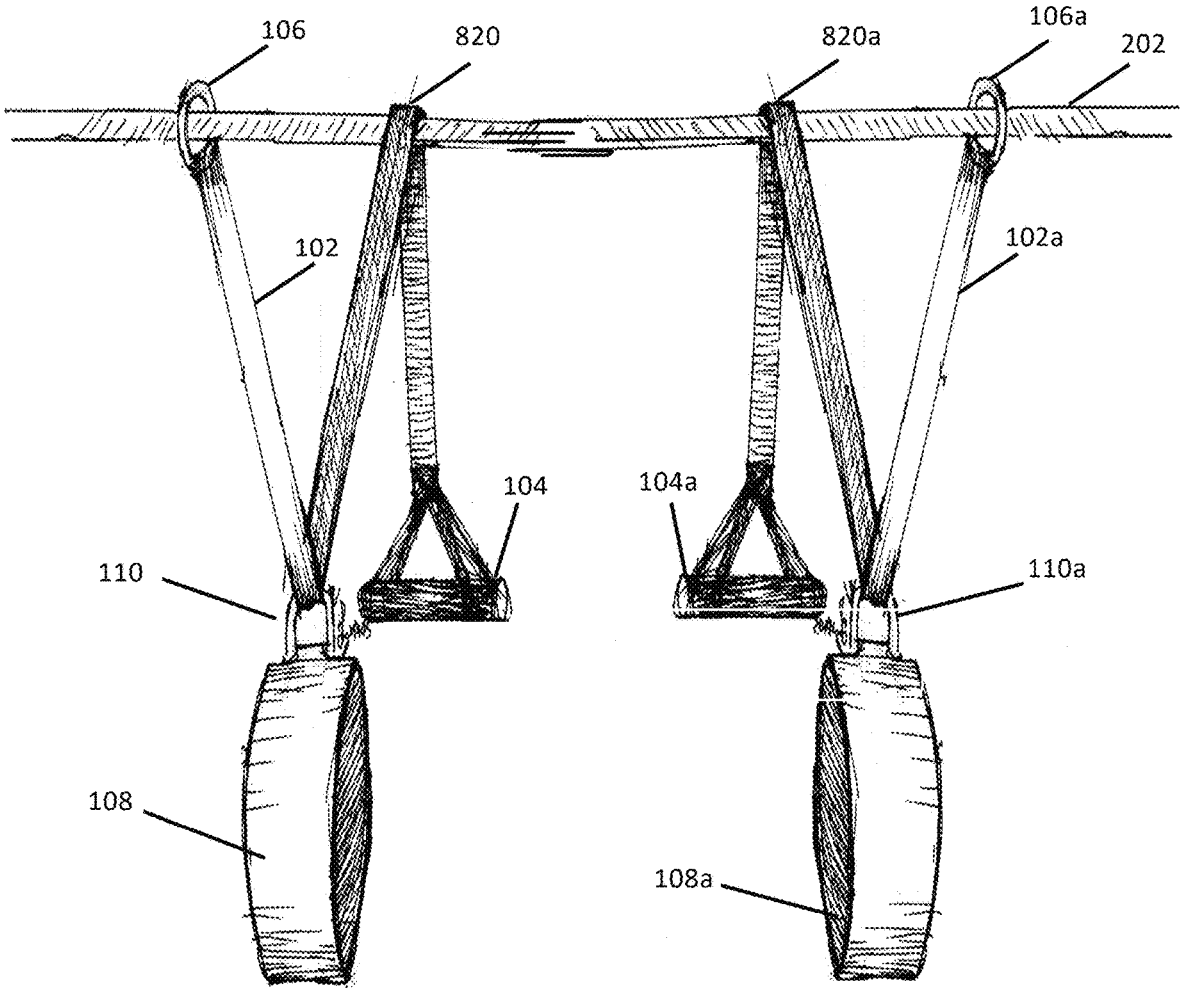
FIG. 6 illustrates a pair of pulley strap and support members or cuffs from FIG. 2 mounted on a horizontal pole or pull-up bar in accordance with the embodiments.

In some embodiments, the abdominal sling exercise device can typically include a pulley system 100 or 600 as shown in FIG. 1 or FIG. 6 for assisting in the performance of exercises having a first belt member 102 having an attachment ring member 106 on a first end and a handle 104 on an opposing end, and a second belt member 102*a* having an attachment ring member 106*a* on a first end and a handle 104*a* on an opposing end (see FIG. 6), where the attachment ring members (106, 106*a*) are configured for attachment to a horizontal pull-up bar 202 and the first belt member 102 and the second belt members 102*a* are configured each for having a portion of the belt member over-hanging the horizontal pullup bar 202. The pulley system (100, 600, 800 of FIG. 8A, or 850 of FIG. 8B) can further include an arm support member (708 of FIG. 8A or 108 and 108*a* of FIG. 8B) having at least two pulley elements (710*a* or 110 and 110*a*) each interfacing with respective intermediate sections of the first belt member and the second belt member which are threaded through the at least two pulley elements (710*a* or 110 and 110*a*), and where the pulley system is configured for supporting a user under their arms using the arm support member while the user simultaneously grabs the overhanging handles (104 and 104*a*) for enabling the user to enhance a leg lifting exercise.

In some embodiments, the corresponding attachment ring members 106 and 106*a* of the first belt member 102 and the second belt member 102*a* are each a carabiner.

Figure 5:
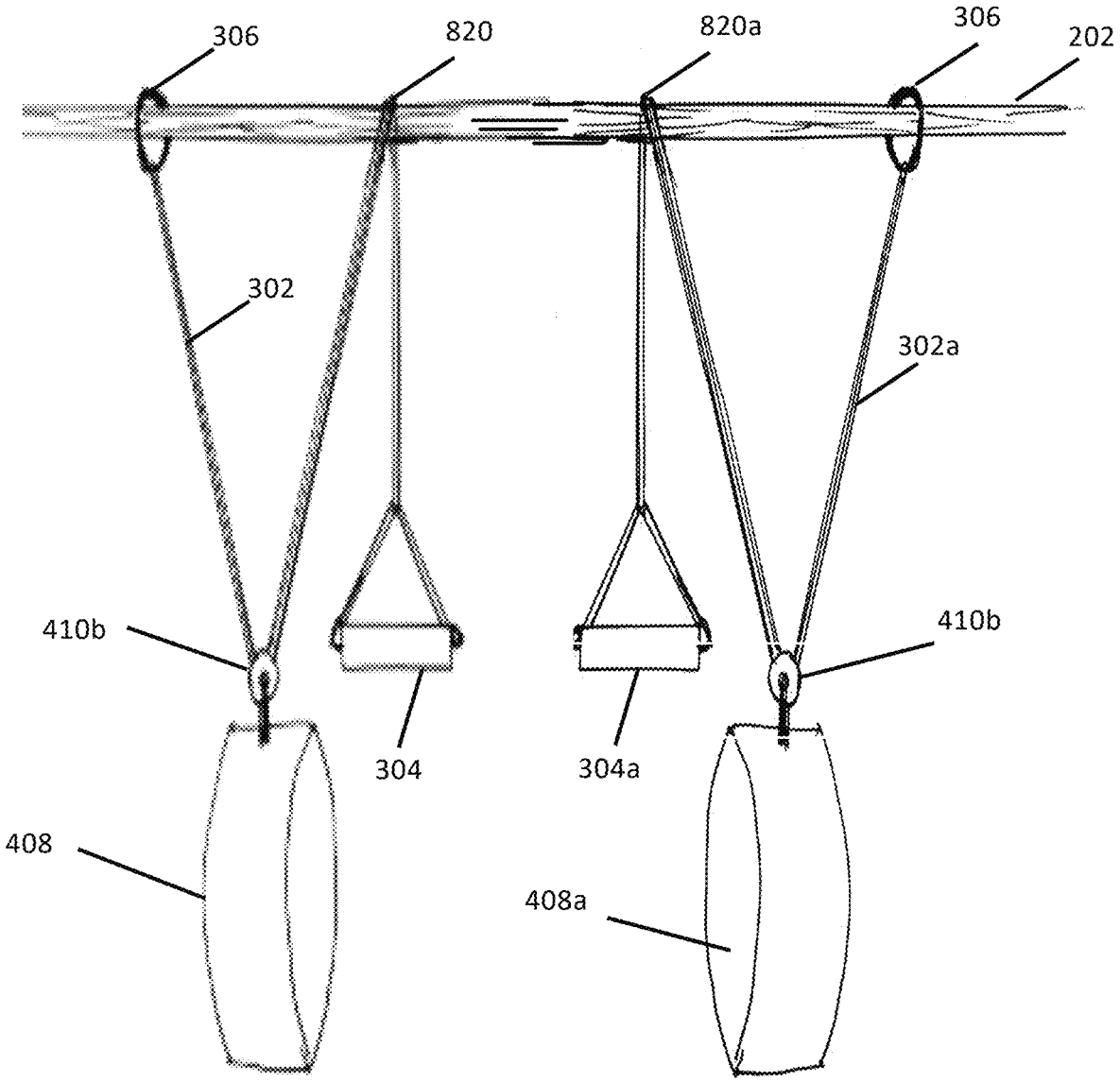
FIG. 5 illustrates a pair of pulley strap and support members or cuffs from FIG. 3 mounted on a horizontal pole or pull-up bar in accordance with the embodiments.

In some embodiments as illustrated in the system 500 of FIG. 5, the first belt member 302 and the second belt member 302*a* are each a rope (instead of a strap or belt). The system 500 can include attachment ring members 306 and 306*a* (such as a carabiner) at one end of the rope (302, 302*a*) that can each attach to a horizontal bar 202 as shown and respective handles 304 and 304*a* that are attached at an opposing end of the rope.

Figure 2:
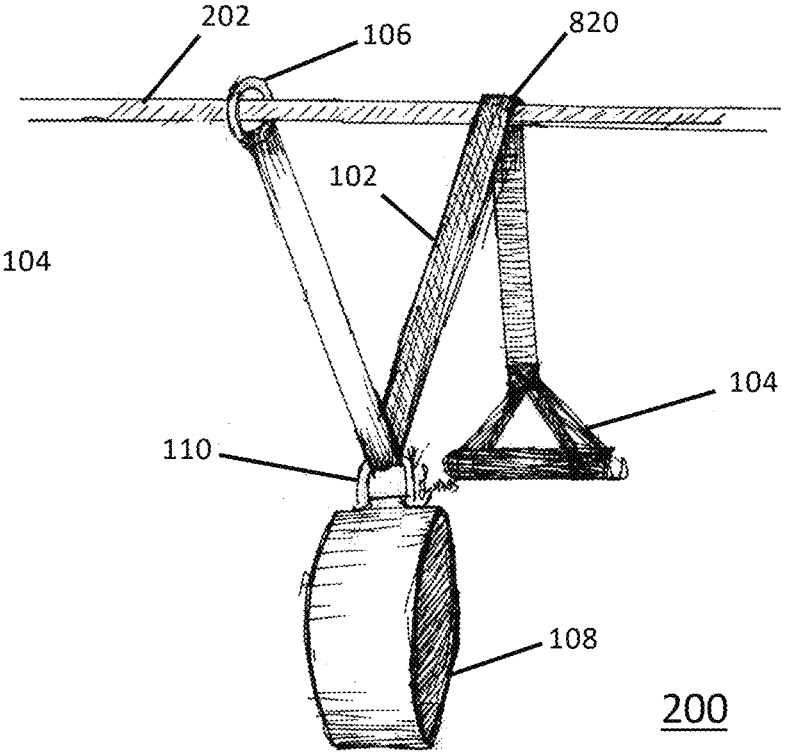
FIG. 2 illustrates pulley strap and support member or cuff of FIG. 1 with a clamp or ring for mounting to a horizonal pole or pull-up bar in accordance with the embodiments.

In some embodiments, the first belt member 102 and the second belt member 102*a* are each a weaved nylon fabric as shown in FIGS. 2 and 6.

Figure 4A:
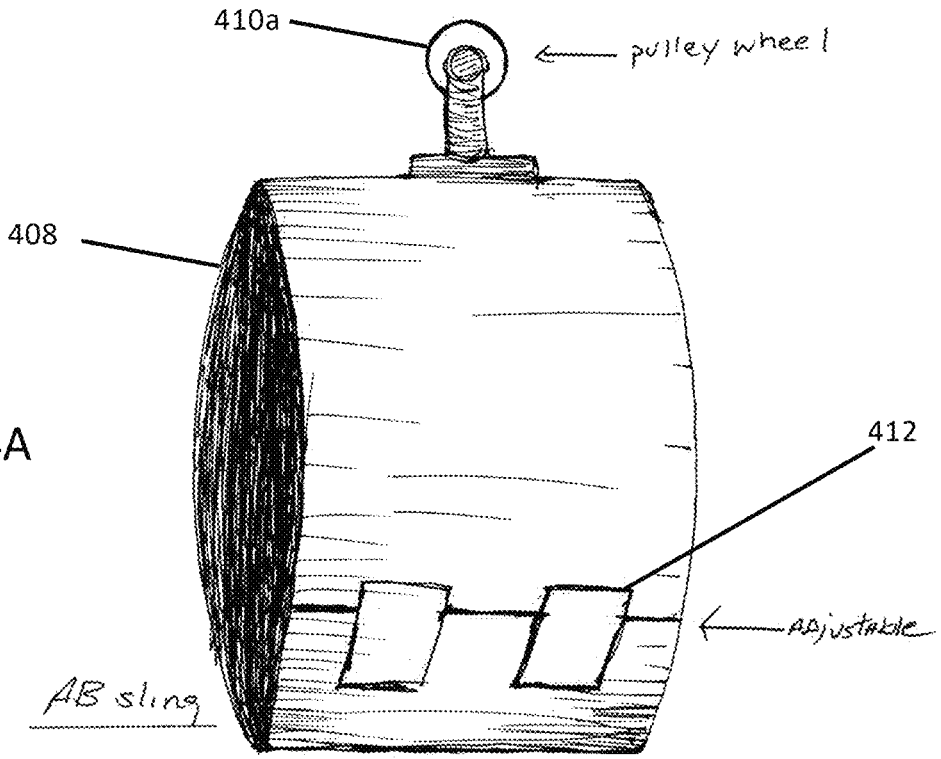
FIG. 4A illustrates a perspective view of a support member or cuff that is adjustable and includes a pulley wheel for supporting a pulley strap or rope in accordance with the embodiments.
Figure 4B:
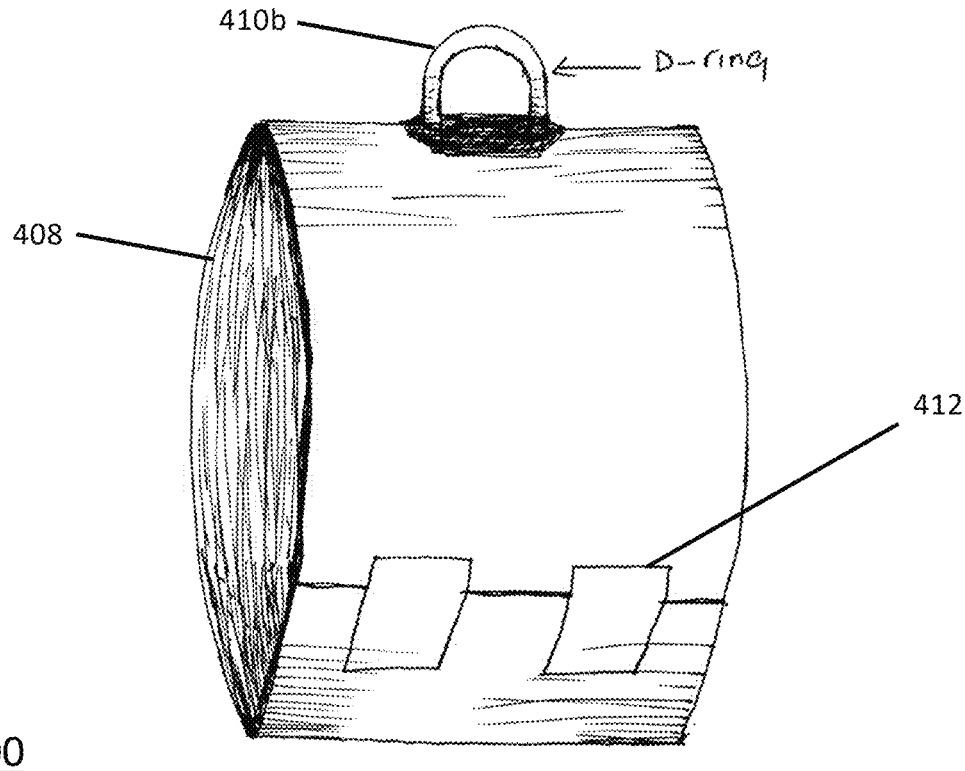
FIG. 4B illustrates a perspective view of a support member or cuff that is adjustable and includes a D-ring for supporting a pulley strap or rope in accordance with the embodiments.
Figure 8A:
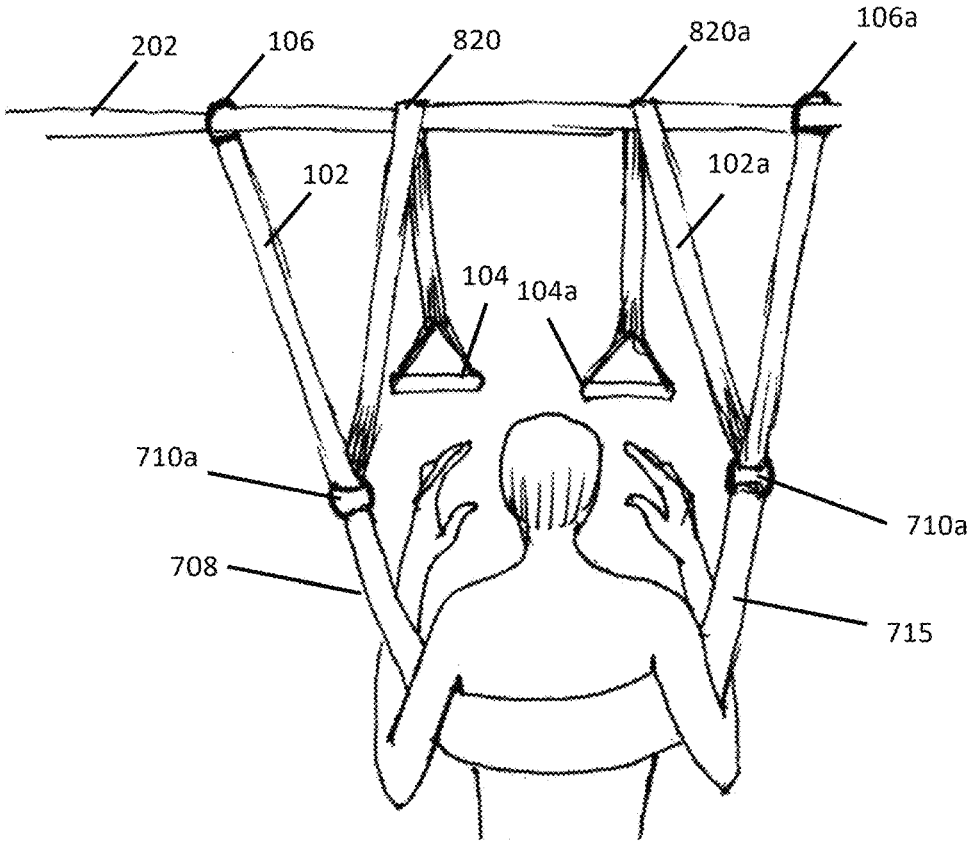
FIG. 8A illustrates an abdominal sling exercise device using the support member of FIG. 7A as utilized by a user in accordance with the embodiments.
Figure 8B:
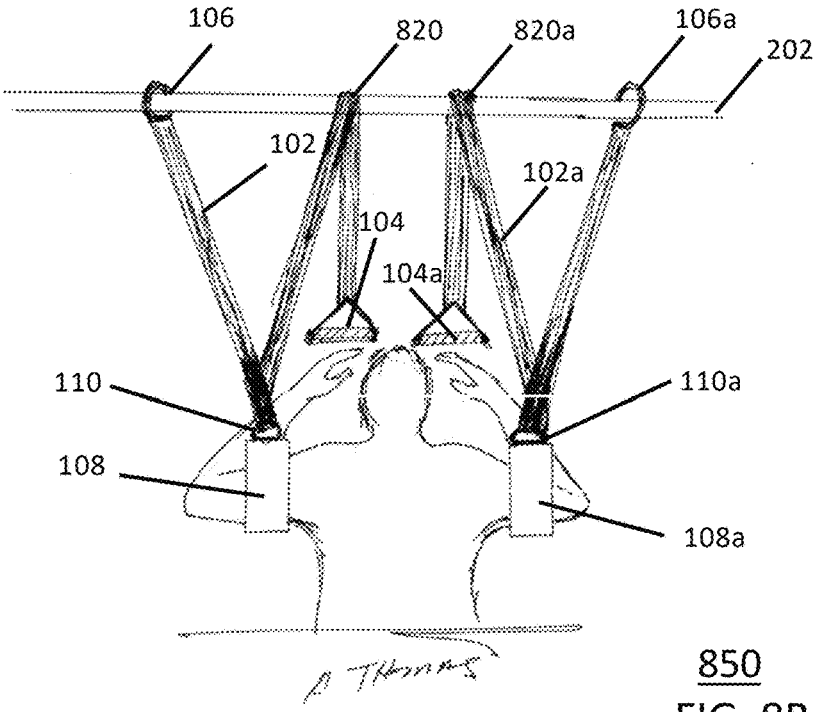
FIG. 8B illustrates an abdominal sling exercise device using the support member or cuff of FIG. 6 as utilized by a user in accordance with the embodiments.

In some embodiments, the arm support member can be a single belt or strap or alternatively a pair of arm cuffs that would in any case support a user underneath their arms when holding handles as shown in FIG. 8A or 8B. In one embodiment, the arm support member includes a first arm cuff 108 or 408 (as shown in FIG. 4B or FIG. 6) having a D-ring 410*b* or 110 where the first belt member 102 is configured to thread through the D-ring 110 of the first arm cuff 108 and the arm support member includes a second arm cuff 108*a* having a D-ring 410*b* or 110*a* wherein the second belt member 102*a* is configured to thread through the D-ring 110*a* of the of the second arm cuff 108*a*. In some embodiments, each of the first arm cuff and the second arm cuff as illustrated in the arm cuff 408 of cuff assembly 400 of FIG. 4B are each adjustable using hook and loop fastener elements 412. Of course, other alternatives for providing an adjustable sizing for the cuffs (for various sizes of arms) are contemplated within the embodiments.

In some embodiments as shown in the system 500 of FIG. 5, the arm support member includes a first arm cuff 408 having a pulley-member 410*b* where the first belt member (in this instance, in the form of a rope 302) is configured to thread through the pulley-member 410*b* of the first arm cuff 408 and the arm support member includes a second arm cuff 408*a* having a pulley-member 410*b* where the second belt member (in this instance, in the form of a rope 302*a*) is configured to thread through the pulley member 410*b* of the of the second arm cuff 408*a*. In some embodiments as shown in the cuff assembly 400 of FIG. 4A, the first arm cuff and the second arm cuff (such as arm cuff 408) are each adjustable, for example, using hook and loop fastener elements 412.

Figure 7A:
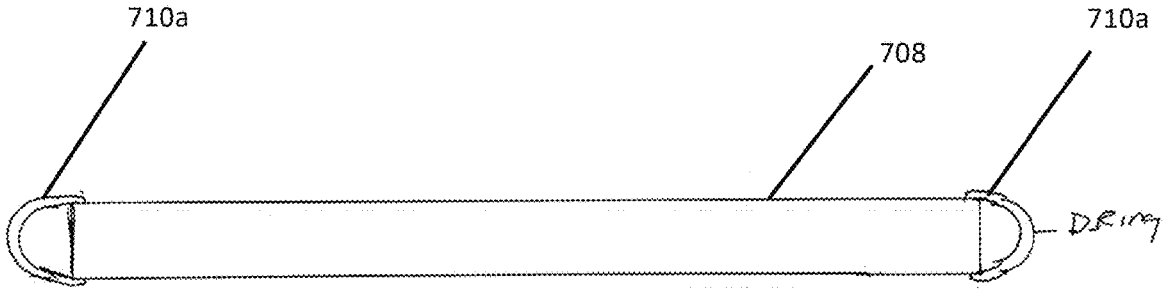
FIG. 7A illustrates a support member in the form of a strap with D-rings on opposing ends in accordance with the embodiments.

In some embodiments, the arm sling support member 700 includes a third belt member 708 (as shown in assembly 700 of FIG. 7A and FIG. 8A having a first D-ring 710*a* and a second D-ring 710*a* respectively on opposing ends of the third belt member 708 where the first belt member 102 is configured to thread through the first D-ring 710*a* of the third belt member 708 and the second belt member 102*a* is configured to thread through the second D-ring 710*a* of the third belt member 708. In some embodiments, the third belt member 708 is surrounded by a cushioned foam layer 715.

Figure 7B:
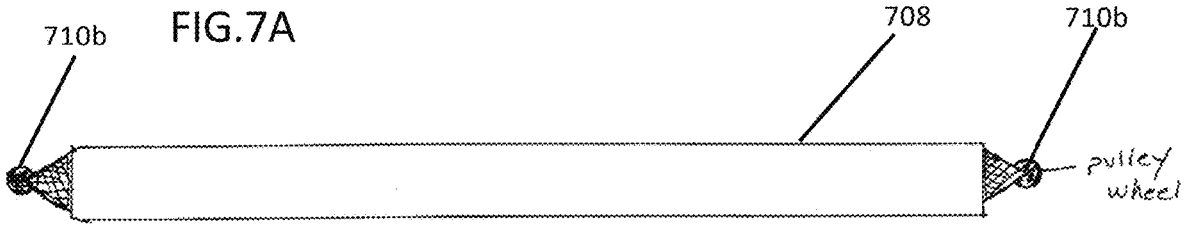
FIG. 7B illustrates a support member in the form of a strap with pulley wheels on opposing ends in accordance with the embodiments.

In some embodiments as shown in FIG. 7B, the arm sling support member 705 includes a third belt member 708 having a first pulley 710*b* and a second pulley 710*b* respectively on opposing ends of the third belt member 708 where the first belt member (such as rope 302 in FIG. 5) is configured to thread through the first pulley 710*b* or 410*b* of the third belt member 708 and the second belt member (such as rope 302*b*) is configured to thread through the second pulley 710*b* of the third belt member 708.

In some embodiments, the rope (302, 302*a*) or belt member (102, 102*a*) are secured or affixed to a robust horizontal bar or pull-up bar that is placed overhead. The rope or belt member can have a loop at its end to secure a ring 106, 106*a* or a carabiner. The rope or belt member passes through a D-ring (such as 110, 110*a*) or pulley (such as 410*b*) of the arm support member which can come in the form of a pair of cuffs (108, 108*a* or alternatively the third belt member 708 or sling. The D-ring 110*a*, pulley 410*b*, or D-ring 710*a* (on the third belt 708) can serve or act as a first pulley for the system. The rope or belt member will have another portion that will go over the pull-up bar 202 at 820 and 820*a* that will act as a second pulley with a handle (104, 104*a*) attached to the free end of each of the belt members 102, 102*a*. The "second pulley" 820 or 820*a* is shown in FIGS. 2, 4, 5, 6, and 8A/8B as examples where the corresponding "first pulley" would be serving at each of 110, 110*a*, 310, 410*b*, 710*a*, 710*b* in various figures.

Figure 3:
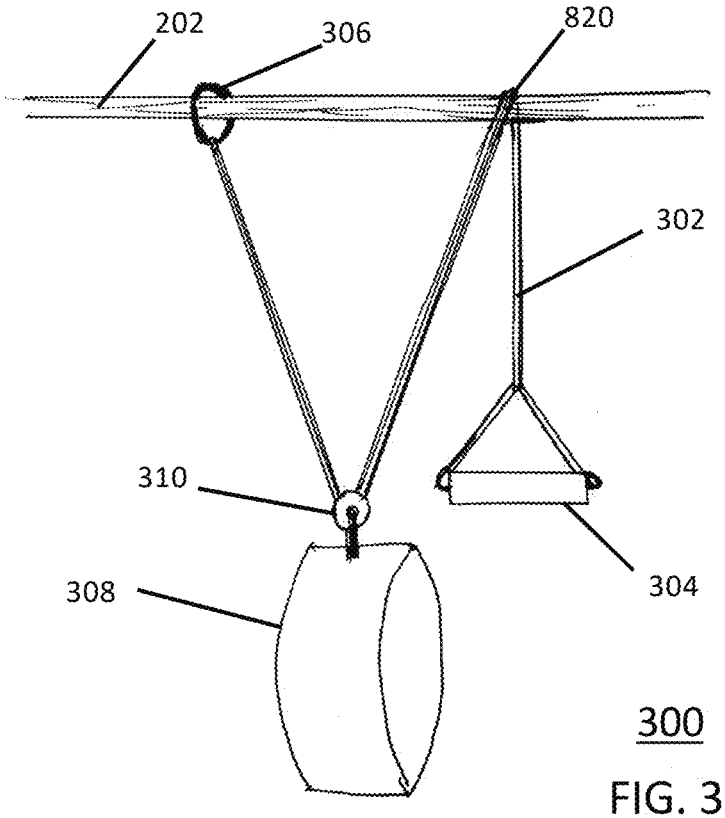
FIG. 3 illustrates yet another pulley strap and support member or cuff of FIG. 1 with a clamp or ring for mounting to a horizonal pole or pull-up bar in accordance with the embodiments

The arrangements found in FIGS. 2 and 3 as well as FIGS. 5, 6, and 8A/8B provide a mechanical advantage (\(MA\)) of a two-pulley system with a single rope or belt which can be calculated as:

$$MA=\frac{2}{1}$$

The resulting mechanical advantage of 2 signifies that the user experiences a halving of the effective load while suspended. This advantage will essentially be doubled using a pair of the individual assemblies 200 or 300 as shown in respective FIGS. 2 and 3 and as further demonstrated in FIGS. 5-8.

For the performance or execution of the leg lift exercises, the user would assume the initial position of the arms within the cuffs or the arm or arm pit over the third belt 708 (or cuffs 108 and 108*a*) as shown in FIG. 8A (or 8B) to ensure proper arm and shoulder placement for stability. The user would then engage the core musculature to initiate the leg lift movement. The mechanical advantage conferred by the pulley system reduces the required effort for suspension, promoting prolonged and controlled leg lift motion. The user can further focus on the contraction of the core and hip flexors throughout the exercise and can capitalize on the reduced muscular fatigue to extend the duration of leg lifts and optimize the workout regimen.

Preliminary investigations utilizing the (two times) two-pulley, single-rope or strap configuration have exhibited notable enhancements in user endurance and muscle activation during leg lift exercises. Participants reported decreased fatigue and heightened engagement of the targeted muscle groups, indicating the efficacy of the proposed biomechanical optimization.

The utilization of a two-pulley, single-rope or strap configuration for leg lift exercises with abdominal straps represents a biomechanically sound approach to enhance exercise efficiency. By leveraging the mechanical advantage of pulleys (and more particularly two pulley functions per belt member or rope), users can sustain suspension for extended durations, thereby facilitating increased muscular activation and endurance. The varying of rope lengths and configurations along with different user positioning may provide further impact and mechanical advantages on the biomechanical outcomes of this method.

In conclusion, the implementation of a two-pulley, single-rope (strap or belt) configuration offers a biomechanically optimized strategy to enhance the effectiveness of leg lift exercises with such system. The resultant mechanical advantage reduces the requisite effort for suspension, allowing users to engage in prolonged and controlled leg lifts, thereby augmenting abdominal muscle activation and endurance. This system and method presents a promising avenue for individuals seeking to optimize their abdominal workout regimens through efficient biomechanical principles.

Figure 9:
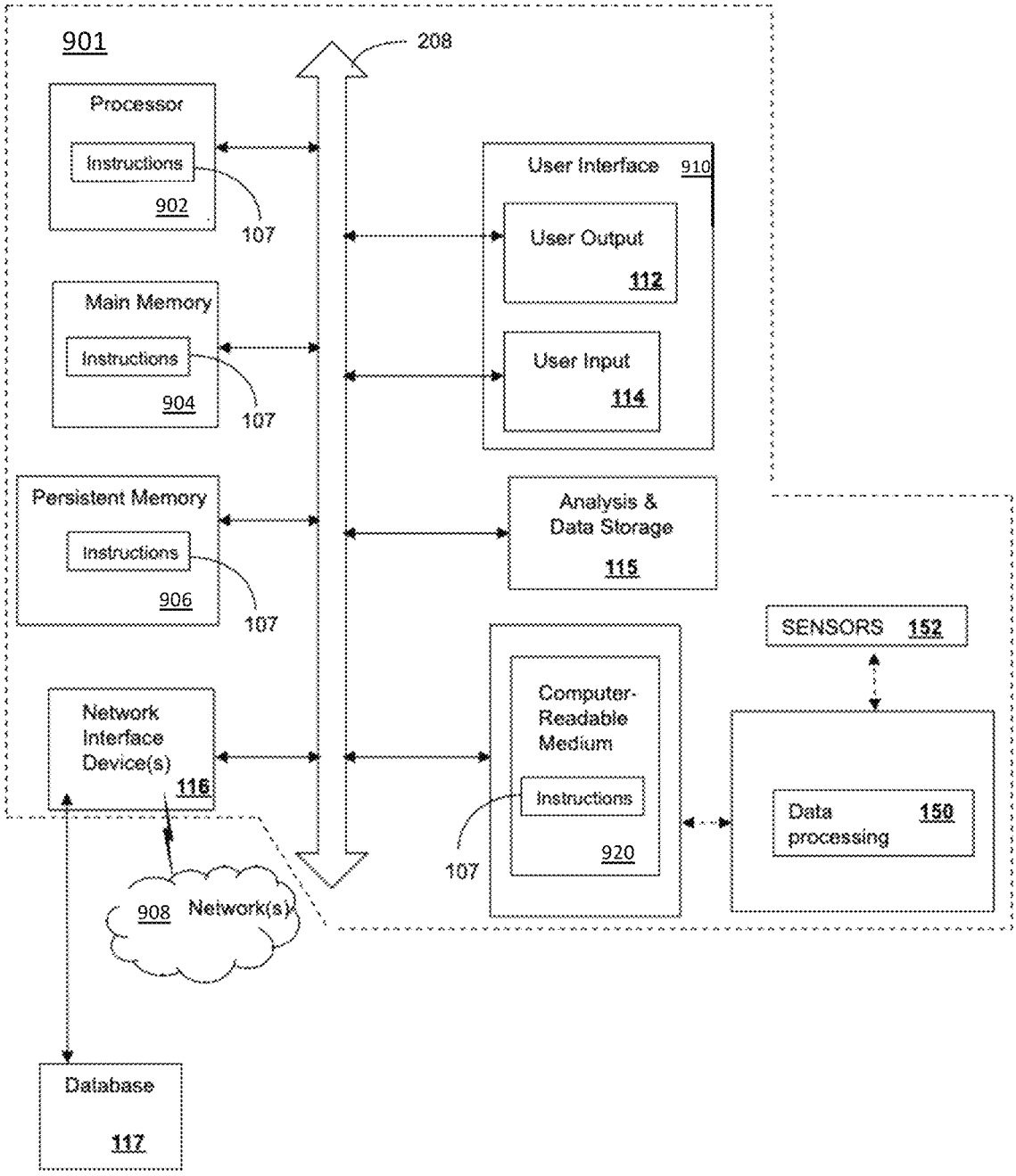
FIG. 9 illustrates a block diagram of a system in accordance with the embodiments.

In some embodiments, and with further references to FIG. 9, a system 900 for an exercise or sit-up harness can include any number and combination of the previously described components above as well as one or more processors which when executing the computer instructions, performs the functions of detecting a count of a repetition of an exercise such as a leg lift.

In some embodiments, the system can utilize artificial intelligence and more particularly machine learning which can use exemplary training data and/or actual commercial use data to further refine what is intended to serve as an exemplary repetition based on a particular environment or a number of known environments. Machine learning is a method of data analysis that automates analytical model building. It is a branch of artificial intelligence based on the idea that systems can learn from data, identify patterns and make decisions with minimal human intervention. Some of the training data that can be used to help identify patterns and make decisions can include fields such as identity codes, scheduling data, location data and/or other parameters obtained from sensors such as cameras, video monitoring devices, audio devices, temperature or other sensor data that can be programmatically configured to more adequately and accurately reflect real world conditions as a system is utilized in a particular environment and hopefully across different environments. Ideally, using machine learning enables systems to automatically learn and improve from experience without being explicitly programmed. Machine learning in the embodiments herein can focus on the development of computer programs (using the Python programming language, for example) to access data and use it to learn for itself in order to better predict when a repetition of an exercise is performed or when it is not fully completed.

In some embodiments, the system can be a client device having one or more computer storage mediums containing computer instructions enabling secure access, storage, transport, and tracking of electronically tagged objects, one or more processors operationally coupled to the one or more computer storage mediums where the one or more processors perform the operations described above.

In some embodiments, the system can further include a computer-storage media coupled to a processor (or processors) and computer-executable instructions embodied in the computer-storage media that, when executed by one or more computing devices, perform a method that perform any number of steps such as performing the method of detecting a characteristic indicative of a sit-up repetition, adding a count to each instance of a detection until a timeout signal is detected or until no repetition indicative of a leg lift or sit-up is detected for a pre-determined period of time.

Various embodiments of the present disclosure can be implemented on an information processing system. The information processing system is capable of implementing and/or performing any of the functionality set forth above. Any suitably configured processing system can be used as the information processing system in embodiments of the present disclosure. The information processing system is operational with numerous other general purpose or special purpose computing system environments, networks, or configurations. Examples of well-known computing systems, environments, and/or configurations that may be suitable for use with the information processing system include, but are not limited to, personal computer systems, server computer systems, thin clients, hand-held or laptop devices, notebook computing devices, multiprocessor systems, mobile devices, microprocessor-based systems, set top boxes, programmable consumer electronics, network PCs, minicomputer systems, mainframe computer systems, Internet-enabled television, and distributed cloud computing environments that include any of the above systems or devices, and the like. As noted previously, the data processing can be any number of data processing techniques suited for tracking repetitions of a particular exercise.

For example, a user with a mobile device may be in communication with a server configured to implement the system using the aforementioned elements, according to an embodiment of the present disclosure. The mobile device can be, for example, a multi-modal wireless communication device, such as a "smart" phone, configured to store and execute mobile device applications ("apps"). Such a wireless communication device communicates with a wireless voice or data network using suitable wireless communications protocols.

The system may include, inter alia, various hardware components such as processing circuitry executing modules that may be described in the general context of computer system-executable instructions, such as program modules, being executed by the system. Generally, program modules can include routines, programs, objects, components, logic, data structures, and so on that perform particular tasks or implement particular abstract data types. The modules may be practiced in various computing environments such as conventional and distributed cloud computing environments where tasks are performed by remote processing devices that are linked through a communications network. In a distributed cloud computing environment, program modules may be located in both local and remote computer system storage media including memory storage devices. Program modules generally carry out the functions and/or methodologies of embodiments of the present disclosure, as described above.

In some embodiments, a system includes at least one memory and at least one or more processor of a computer system communicatively coupled to the at least one memory. The at least one processor can be configured to perform a method including methods described above.

According to yet another embodiment of the present disclosure, a computer readable storage medium comprises computer instructions which, responsive to being executed by one or more processors, cause the one or more processors to perform operations as described in the methods or systems above or elsewhere herein.

As shown in FIG. 9, an information processing system 901 of a system 900 can be communicatively coupled with the data processing module 150 and a group of client or other devices, or coupled to a presentation device for display at any location at a terminal or server location. According to this example, at least one processor 902, responsive to executing instructions 107, performs operations to communicate with the processing module 150 via a bus architecture 208, as shown. The at least one processor 902 is communicatively coupled with main memory 904, persistent memory 906, and a computer readable medium 120. The processor 902 is communicatively coupled with an Analysis & Data Storage 115 that, according to various implementations, can maintain stored information used by, for example, the data processing module 150 and more generally used by the information processing system 900. The data processing module 150 can be coupled to one or more sensors 152 as needed. Such sensors can be barcode scanners, fingerprint readers, proximity sensors, microphones, cameras, video cameras, location sensors, motion detectors, scales, tension sensors, biometric reading devices (e.g., iris scanners, facial recognition scanners, voice detection devices) and other devices as contemplated herein. Optionally, this stored information can be received from the client or other devices. For example, this stored information can be received periodically from the client devices and updated or processed over time in the Analysis & Data Storage 115. Additionally, according to another example, a history log can be maintained or stored in the Analysis & Data Storage 115 of the information processed over time. The data processing module 150, and the information processing system 900, can use the information from the history log such as in the analysis process and in making decisions related to a particular user's access or for logging electronically tagged objects according to a database of best practices for a particular procedure or procedures.

The computer readable medium 920, according to the present example, can be communicatively coupled with a reader/writer device (not shown) that is communicatively coupled via the bus architecture 208 with the at least one processor 102. The instructions 107, which can include instructions, configuration parameters, and data, may be stored in the computer readable medium 920, the main memory 904, the persistent memory 906, and in the processor's internal memory such as cache memory and registers, as shown.

The information processing system 900 includes a user interface (or interfaces) 910 that comprises a user output interface 112 and user input interface 114. Examples of elements of the user output interface 112 can include a display, a speaker, one or more indicator lights, one or more transducers that generate audible indicators, and a haptic signal generator or any of the interfaces illustrated or discussed with respect to the figures or elsewhere in the application. Examples of elements of the user input interface 114 can include a keyboard, a keypad, a mouse, a track pad, a touch screen, a touch pad, a microphone that receives audio signals, a camera, a video camera, a CT-Scanner, or any other scanner that scans images. Some user inputs can be sensors or vice-versa. The received audio signals or scanned images, for example, can be converted to electronic digital representations and stored in memory, and optionally can be used with corresponding voice or image recognition software executed by the processor 902 to receive user input data and commands, or to receive test data for example. The voice recognition software can be used to enter or check off items on a checklist and further provide data or text entry allowing the user to enter notes or data as needed.

A network interface device 116 is communicatively coupled with the at least one processor 902 and provides a communication interface for the information processing system 900 to communicate via one or more networks 908. The networks 908 can include wired and wireless networks, and can be any of local area networks, wide area networks, or a combination of such networks. For example, wide area networks including the internet and the web can intercommunicate the information processing system 900 with other one or more information processing systems that may be locally, or remotely, located relative to the information processing system 900. It should be noted that mobile communications devices, such as mobile phones, Smart phones, tablet computers, lap top computers, and the like, which are capable of at least one of wired and/or wireless communication, are also examples of information processing systems within the scope of the present disclosure. The network interface device 116 can provide a communication interface for the information processing system 900 to access the at least one database 117 according to various embodiments of the disclosure.

The instructions 107, according to the present example, can include instructions for monitoring, instructions for analyzing, instructions for retrieving and sending information and related configuration parameters and data. It should be noted that any portion of the instructions 107 can be stored in a centralized information processing system or can be stored in a distributed information processing system, i.e., with portions of the system distributed and communicatively coupled together over one or more communication links or networks.

FIGS. 1-9 illustrate examples of systems, methods or process flows, according to various embodiments of the present disclosure, which can operate in conjunction with the information processing system 900 of FIG. 9.

The invention claimed is:

1. A pulley system for assisting in the performance of exercises, comprising:

a first belt member having an attachment ring member on a first end and a handle on an opposing end;

a second belt member having an attachment ring member on a first end and a handle on an opposing end, wherein the attachment ring members are configured for attachment to a horizontal pull-up bar and the first belt member and the second belt members are configured each for having a respective portion of the first belt member and the second belt member over-hanging the horizontal pullup bar;

an arm support member having at least two pulley elements each interfacing with respective intermediate sections of the first belt member and the second belt member which are threaded through the at least two pulley elements; and wherein the pulley system is configured for supporting a user under their arms using the arm support member while the user simultaneously grabs the handles for enabling the user to enhance a leg lifting exercise.

2. The pulley system of claim 1, wherein the attachment ring members of the first belt member and the second belt member are each a carabiner.

3. The pulley system of claim 1, wherein the first belt member and the second belt member are each a rope.

4. The pulley system of claim 1, wherein the first belt member and the second belt member are each a weaved nylon fabric.

5. The pulley system of claim 1, wherein the arm support member comprises a first arm cuff having a D-ring wherein the first belt member is configured to thread through the D-ring of the first arm cuff and the arm support member comprises a second arm cuff having a D-ring wherein the second belt member is configured to thread through the D-ring of the of the second arm cuff.

6. The pulley system of claim 5, wherein the first arm cuff and the second arm cuff are each adjustable using hook and loop fastener elements.

7. The pulley system of claim 1, wherein the arm support member comprises a first arm cuff having a pulley-member of the at least two pully elements wherein the first belt member is configured to thread through the pulley-member of the first arm cuff and the arm support member comprises a second arm cuff having a pulley-member of the at least two pulley elements wherein the second belt member is configured to thread through the pulley member of the of the second arm cuff.

8. The pulley system of claim 7, wherein the first arm cuff and the second arm cuff are each adjustable using hook and loop fastener elements.

9. The pulley system of claim 1, wherein the arm support member comprises a third belt member having a first D-ring and a second D-ring respectively on opposing ends wherein the first belt member is configured to thread through the first D-ring of the third belt member and the second belt member is configured to thread through the second D-ring of the third belt member.

10. The pulley system of claim 9, wherein the third belt member is surrounded by a cushioned foam layer.

11. The pulley system of claim 1, wherein the arm support member comprises a third belt member having a first pulley and a second pulley respectively on opposing ends wherein the first belt member is configured to thread through the first pulley of the third belt member and the second belt member is configured to thread through the second pulley of the third belt member.

12. A pulley system for assisting in the performance of exercises, comprising:

a first belt member having an attachment ring member on a first end and a handle on an opposing end;

a second belt member having an attachment ring member on a first end and a handle on an opposing end, wherein the attachment ring members are configured for attachment to a horizontal pull-up bar and the first belt member and the second belt members are configured each for having a portion of the belt member and the belt member over-hanging the horizontal pullup bar;

a first arm cuff having a D-ring wherein the first belt member is configured to thread through the D-ring of the first arm cuff; and a second arm cuff having a D-ring wherein the second belt member is configured to thread through the D-ring of the of the second arm cuff, wherein the D-rings serve as pulley elements each interfacing with respective intermediate sections of the first belt member and the second belt member which are threaded through the pulley elements; and wherein the pulley system is configured for supporting a user under their arms using the first arm cuff and second arm cuff while the user simultaneously grabs the handles for enabling the user to enhance a leg lifting exercise.

13. The pulley system of claim 12, wherein the attachment ring members of the first belt member and the second belt member are each a carabiner.

14. The pulley system of claim 12, wherein the first belt member and the second belt member are each a rope.

15. The pulley system of claim 12, wherein the first belt member and the second belt member are each a weaved nylon fabric.

16. The pulley system of claim 12, wherein the first arm cuff and the second arm cuff are each adjustable using hook and loop fastener elements.

17. A pulley system for assisting in the performance of exercises, comprising:

a first belt member having an attachment ring member on a first end and a handle on an opposing end;

a second belt member having an attachment ring member on a first end and a handle on an opposing end, wherein the attachment ring members are configured for attachment to a horizontal pull-up bar and the first belt member and the second belt members are configured each for having a portion of the belt member and the belt member over-hanging the horizontal pullup bar;

a first arm cuff having a pulley element wherein the first belt member is configured to thread through the pulley element of the first arm cuff; and a second arm cuff having a pulley element wherein the second belt member is configured to thread through the pulley element of the of the second arm cuff, wherein the pulley elements serve as pulley elements each interfacing with respective intermediate sections of the first belt member and the second belt member which are threaded through the pulley elements; and wherein the pulley system is configured for supporting a user under their arms using the first arm cuff and second arm cuff while the user simultaneously grabs the handles for enabling the user to enhance a leg lifting exercise.

18. The pulley system of claim 17, wherein the pulley element of the first arm cuff and the pulley element of the second arm cuff are each D-rings.

19. The pulley system of claim 17, wherein the pulley element of the first arm cuff and the pulley element of the second arm cuff are each a pulley.

20. The pulley system of claim 19, wherein the first belt member and the second belt member are each a rope.

* * * * *